US009140073B2

(12) United States Patent
Zhou

(10) Patent No.: US 9,140,073 B2
(45) Date of Patent: Sep. 22, 2015

(54) DRILL BIT FOR USE IN BORING A WELLBORE AND SUBTERRANEAN FRACTURING

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 345 days.

(21) Appl. No.: 13/711,693

(22) Filed: Dec. 12, 2012

(65) Prior Publication Data

US 2013/0161102 A1 Jun. 27, 2013

Related U.S. Application Data

(60) Provisional application No. 61/580,038, filed on Dec. 23, 2011.

(51) Int. Cl.

| | |
|---|---|
| ***E21B 10/38*** | (2006.01) |
| ***E21B 10/61*** | (2006.01) |
| ***E21B 43/26*** | (2006.01) |
| ***E21B 21/10*** | (2006.01) |
| ***E21B 10/60*** | (2006.01) |
| ***E21B 10/00*** | (2006.01) |

(52) U.S. Cl.

CPC ..... *E21B 10/60* (2013.01); *E21B 10/00* (2013.01); *E21B 21/10* (2013.01); *E21B 43/26* (2013.01)

(58) Field of Classification Search

CPC ..... E21B 10/38; E21B 10/602; E21B 10/60; E21B 10/61; E21B 10/322; E21B 10/32; E21B 43/26; E21B 21/10

See application file for complete search history.

(56) References Cited

U.S. PATENT DOCUMENTS

| | | | | |
|---|---|---|---|---|
| 2,307,658 | A * | 1/1943 | Appleby | 175/317 |
| 3,547,191 | A | 12/1970 | Malott | |
| 4,534,426 | A | 8/1985 | Hooper | |
| 5,363,927 | A | 11/1994 | Frank | |
| 5,788,000 | A * | 8/1998 | Maury et al. | 175/325.1 |

(Continued)

FOREIGN PATENT DOCUMENTS

WO 03010410 A1 2/2003

OTHER PUBLICATIONS

PCT International Search Report and The Written Opinion of the International Searching Authority dated Apr. 11, 2014; International Application No. PCT/US2012/070459; International File Date: Dec. 19, 2012.

(Continued)

*Primary Examiner* — Cathleen Hutchins

(74) *Attorney, Agent, or Firm* — Bracewell & Giuliani LLP; Constance Gall Rhebergen; Keith R. Derrington

(57) ABSTRACT

A drill bit for use in drilling a wellbore and that can be used for fracturing the subterranean formation surrounding the wellbore. Included on the bit body is a packer for sealing against the wellbore wall during fracturing. A chamber in the drill bit houses a valve assembly for selectively diverting fluid between use in drilling and for use in fracturing. The fluid is delivered through a drill string that attaches to an upper end of the bit. The valve assembly can be shuttled between drilling and fracturing configurations by selectively adjusting an amount and/or pressure of the fluid flowing in the drill string.

16 Claims, 4 Drawing Sheets

(56) References Cited

U.S. PATENT DOCUMENTS

| | | | |
|---|---|---|---|
| 7,168,491 | B2 | 1/2007 | Malone et al. |
| 7,516,792 | B2 | 4/2009 | Lonnes et al. |
| 7,958,952 | B2 | 6/2011 | Kusko et al. |
| 2005/0011678 | A1 | 1/2005 | Akinlade et al. |
| 2009/0272580 | A1 | 11/2009 | Dolman et al. |
| 2010/0089574 | A1 | 4/2010 | Wideman et al. |
| 2011/0126674 | A1 | 6/2011 | Felderhoff et al. |

OTHER PUBLICATIONS

PCT Partial International Search Report of the International Searching Authority dated Jan. 27, 2014; International Application No. PCT/US2012/070459; International File Date: Dec. 19, 2012.

* cited by examiner

DRILL BIT FOR USE IN BORING A WELLBORE AND SUBTERRANEAN FRACTURING

CROSS REFERENCE TO RELATED APPLICATIONS

This application claims priority to and the benefit of U.S. Provisional Application Ser. No. 61/580,038, filed Dec. 23, 2011, the full disclosure of which is hereby incorporated by reference herein for all purposes.

BACKGROUND OF THE INVENTION

1. Field of the Invention

The present invention relates to an earth boring bit for use in forming a wellbore. More specifically, the invention relates to a bit having a packer that is selectively deployable for fracturing a subterranean formation while at the same time drilling a wellbore in the formation.

2. Description of the Related Art

Hydrocarbon producing wellbores extend subsurface and intersect subterranean formations where hydrocarbons are trapped. The wellbores generally are created by drill bits that are on the end of a drill string, where typically a drive system above the opening to the wellbore rotates the drill string and bit. Drill bits are usually equipped with cutting elements that scrape the bottom of the wellbore as the bit is rotated to excavate material from the formation, thereby deepening the wellbore. Drilling fluid is typically pumped down the drill string and directed from the drill bit into the wellbore, where it then flows back up the wellbore in an annulus between the drill string and walls of the wellbore. The drilling fluid cools the bit, maintains a desired pressure in the well, and when flowing up the wellbore carries with it cuttings produced while excavating.

To improve a flow of hydrocarbons from the formation to the wellbore, fractures are sometimes created into the formation from the wall of the wellbore. Fracturing is typically performed by injecting high pressure fluid into the wellbore and sealing off a portion of the wellbore. Fracturing generally initiates when the pressure in the wellbore exceeds the rock strength in the formation. The fractures are usually supported by injection of a proppant, such as sand or resin coated particles; which also employed for blocks the production of sand or other particulate matter from the formation into the wellbore.

SUMMARY OF THE INVENTION

Described herein is an earth boring bit for use in drilling a wellbore and that can be used for fracturing the subterranean formation surrounding the wellbore. In an example the earth boring bit includes a body, a connection for selectively attaching the bit to a drill string. A chamber is in the body that is in selective fluid communication with an inside of the drill string. The bit further includes an exit nozzle that discharges on an outer surface of the body; the exit nozzle is in selective communication with the chamber. A fracturing port is on the bit that has a discharge on an outer surface of the body and is in selective communication with the chamber. Also included in the bit is a valve assembly in the chamber selectively moveable from a drilling position that blocks fluid communication between the fracturing port and chamber to a fracturing position that blocks fluid communication between the exit nozzle and chamber. In an embodiment, the valve assembly includes a sleeve, an elongated plunger mounted in the sleeve, and apertures in the sleeve. In this example, when the valve assembly is in the drilling position, a solid portion of the sleeve is disposed adjacent an interface between the chamber and the fracturing port so that fluid communication between the chamber and fracturing is blocked. Alternatively, when the valve assembly is in the fracturing position, the apertures register with the fracturing port and an end of the plunger seals an interface between the exit nozzle and the chamber. In one example, the valve assembly is moveable from the drilling position to the fracturing position by flowing a designated amount of fluid through the drill string and into the drill bit. The bit can further include a spring in the chamber on an end of the sleeve for moving the valve assembly from the fracturing position to the drilling position. Optionally, the plunger is substantially cylindrical and coaxially connected to the sleeve by web members that extend radially between the plunger and the sleeve. In one alternate embodiment, the bit further includes a selectively expandable packer disposed on the body, so that when the packer is in communication with pressurized fluid in the drill string, the packer expands radially outward into sealing contact with an inner surface of a wellbore. Blades may be included with the bit that are fixed on an outer surface of the body that have an elongate side disposed substantially parallel with an axis of the body to define channels between adjacent blades. In this example also included are sliding blades on an outer surface of the body that are selectively moveable into and out of the channels. In one embodiment, the sliding blades are connected to the sleeve by a linkage that extends through slots in the body.

Also disclosed herein is an example of an earth boring bit that is made up of a body having a connection for selective attachment to a drill string, a chamber in the body in communication with an annulus in the drill string, a discharge nozzle on the body in selective communication with the chamber, and a sealing element on the body that selectively expands radially outward into sealing engagement with an inner surface of a wellbore wall when the bit is disposed in the wellbore. The sealing element can include a packer that is filled with fluid from the annulus of the drill string to expand radially outward. The bit may further have a valve assembly disposed in the chamber for providing communication between the chamber and the discharge nozzle. In this example the discharge nozzle is a fracturing port and the valve assembly includes a sleeve having a radially formed aperture and that is moveable from a blocking position with a solid portion of the sleeve adjacent an interface between the fracturing port and chamber to block communication between the chamber and fracturing port, to a communication position with the aperture registered with the interface so that the fracturing port is in communication with the chamber through the aperture. The discharge nozzle can be a drilling fluid nozzle, in this example the valve assembly includes a substantially cylindrical plunger that is moveable to adjacent an interface between the drilling fluid nozzle and chamber to block communication between the chamber and drilling fluid nozzle. In an alternative embodiment, the discharge nozzle is a drilling fluid nozzle and the bit further includes a fracturing port, and wherein when the bit is operated to drill the wellbore, the valve assembly blocks communication between the fracturing port and the chamber and opens communication between the drilling fluid nozzle and the chamber, and wherein when the bit is operated to fracture the wellbore, the valve assembly opens communication between the fracturing port and the chamber and blocks communication between the drilling fluid nozzle and the chamber. Optionally, the discharge nozzle includes a drilling fluid nozzle, in this example the bit further includes a fracturing port that is disposed between the drilling fluid nozzle and the connection on the body.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
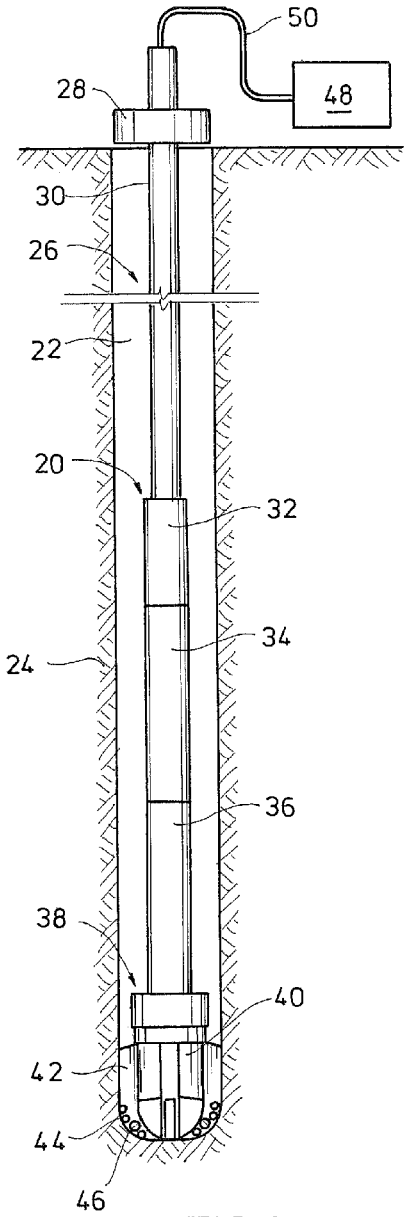
FIG. 1 is a side partial sectional view of an example embodiment of forming a wellbore using a drilling system having a drill bit in accordance with the present invention.

An example embodiment of a drilling system 20 is provided in a side partial sectional view in FIG. 1. In the example of FIG. 1, the drilling system 20 is shown forming a wellbore 22 through a formation 24. The drilling system 20 illustrated is made up of an elongated drill string 26 that receives a rotational force from a drive system 28 shown schematically represented on the surface and above an opening of the wellbore 22. Examples of the drive system 28 include a top drive and rotary table. A number of segments of drill pipe 30 threadingly attached together form an upper portion of the drill string 26. An optional swivel master 32 is schematically illustrated on a lower end of the drill pipe 30. As is known, implementation of the swivel master 32 allows the portion of the drill string 26 above the swivel master 32 to be rotated without any rotation or torque being applied to the string 26 below the swivel master 32. The lower end of the swivel master 32 is shown connected to an upper end of a directional drilling assembly 34; which can be equipped with gyros or other directional type devices for steering the lower end of the drill string 26. Also optionally provided is an intensifier 36 coupled on a lower end of the directional drilling assembly 34. In one example, the pressure intensifier 36 receives pressurized fluid and discharges the fluid at a greater pressure.

An example of a drill bit assembly 38 is shown mounted on a lower end of the intensifier 36, and includes a drill bit 40, shown as a drag or fixed bit, but may also include extend gauge rotary cone type bits. Cutting blades 42 extend axially along an outer surface of the drill bit 40 and are shown having cutters 44 that may be cylindrically shaped members, or optionally formed from a polycrystalline diamond material. Further included with the drill bit 40 of FIG. 1 are nozzles 46 shown dispersed between the cutters 44 for discharging drilling fluid from the drill bit 40 during drilling operations. As is known, the fluid exiting the nozzles 46 both cools the cutters 44 due to the heat generated with rock cutting action and hydraulically flushing cuttings away as soon as they are created, and recirculates up the wellbore 22 carrying with it rock formation cuttings produced while excavating the wellbore 22. The drilling fluid may be provided from a storage tank 48 shown on the surface that leads the fluid into the drill string 26 via a line 50.

Figure 2:
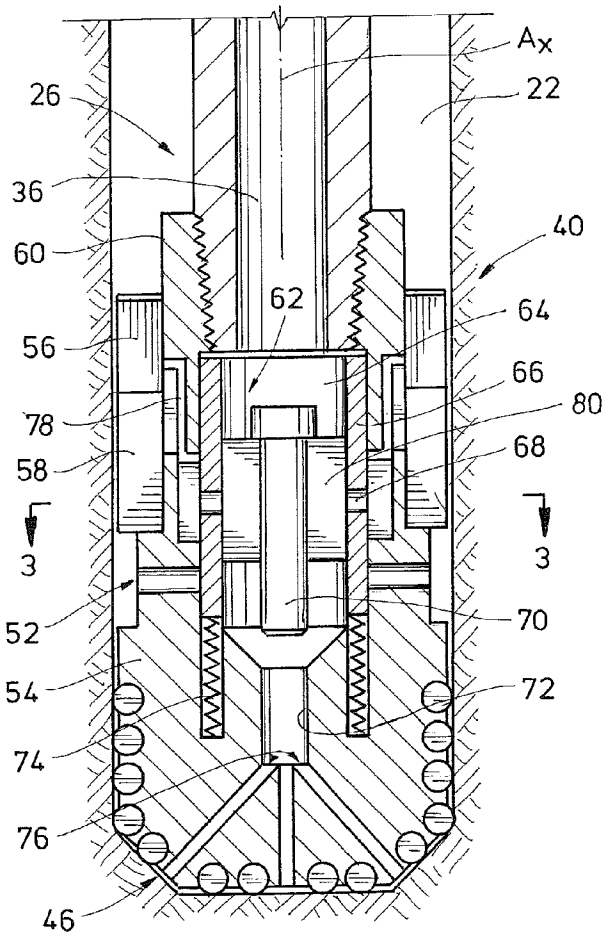
FIG. 2 is a side view of an example of the drill bit of FIG. 1 in accordance with the present invention.

FIG. 2 illustrates a detailed side sectional view of an example of the bit 40 of FIG. 1. The bit 40 of FIG. 2 is depicted in a drilling mode wherein fluid, such as from tank 48 (FIG. 1), is directed through the drill string 26 and into the bit 40 and discharged out from the nozzles 46. Fracturing nozzles 52 are shown formed in a body 54 of the bit 40. In addition to the fixed rigid blades 42 on the bit 40 are sliding blades 56 that mount on the body 54 above the fracturing nozzles 52. The sliding blades 56, shown as members having an elongate side substantially parallel with an axis $A_X$ of bit 40, may optionally slide downward into slots 58 disposed also above the fracturing nozzles 52. Mounted on an upper end of the bit 40 is a collar 60; which as will be described in more detail below, includes a means for sealing against the wellbore 22.

A valve assembly 62 is shown disposed within a chamber 64 provided within the bit body 54. The valve assembly 62 is made up of an annular sleeve 66 that coaxially sets within the chamber 64 and is axially slideable therein. Ports 68 are shown formed laterally through a side wall of the sleeve 66, that are adjacent a solid side wall portion of the body 54 when in the drilling configuration of FIG. 2. An elongated plunger 70 is also included with the valve assembly 62 and shown set substantially aligned with axis $A_X$ of the bit 40. In one example, the plunger 70 has a substantially cylindrical configuration. An annular wall 72 is formed on a lower end of the chamber 64 shown substantially coaxial with the plunger 70. In the example of FIG. 2, the wall 72 has an outer periphery that is set radially inward from the outer surface of the chamber 64, thereby defining an annular space between the wall 72 and walls of the chamber 64. Springs 74 are optionally shown set within the annular space between the wall 72 and periphery of chamber 64. As provided below, the springs 74 can provide an upward urging force against the sleeve 66. A series of passages 76 are shown extending from a lower end of the chamber 64, through the bit body 54. The passages 76 transition into the exit nozzles 46 for discharging the drilling fluid from the bit 40. Schematically illustrated in FIG. 2 are linkages 78 shown connecting an outer surface of the sleeve 66 with the sliding blades 56. As will be described in further detail below, axial movement of the sleeve 66 can thereby cause corresponding movement of the blades 56 as well.

Figure 3:
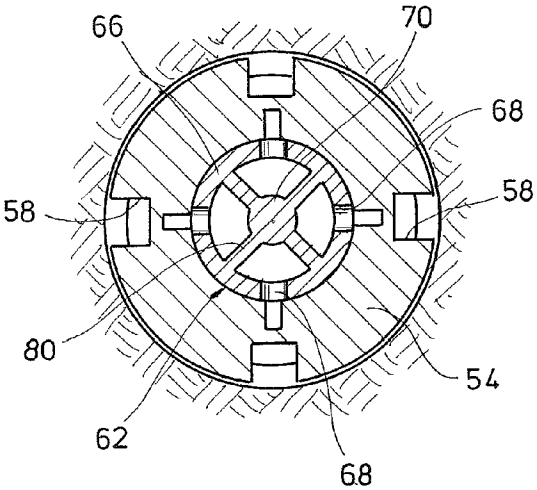
FIG. 3 is an axial sectional view of an example of the bit of FIG. 2 in accordance with the present invention.

FIG. 3, which is taken along lines 3-3 of FIG. 2, provides an axial sectional example of the bit 40 and a portion of the valve assembly 62. In this example, webs 80 extend radially outward from an outer surface of the plunger 70, span across an annulus between the plunger 70 and sleeve 66, and into connection with an inner surface of the sleeve 66. The webs 80 structurally couple the plunger 70 with sleeve 66 and subdivide the annulus into curved portions.

Figure 4:
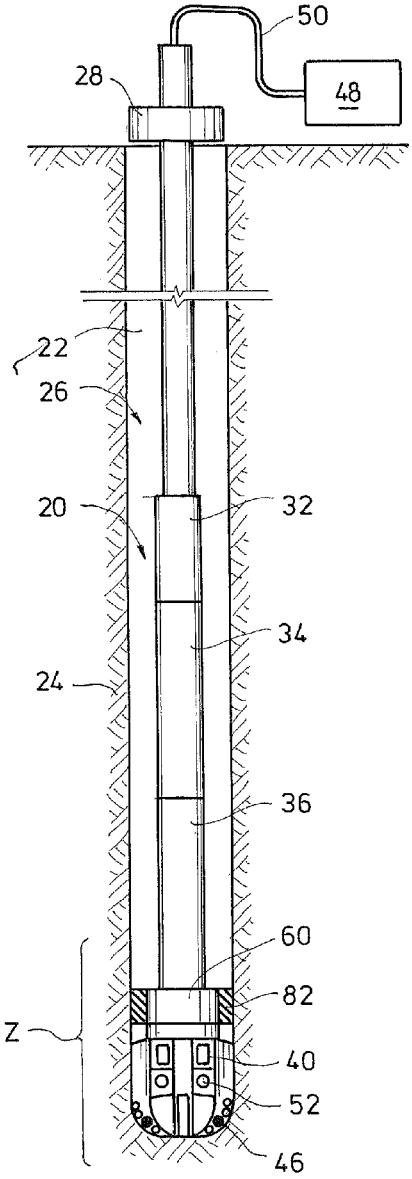
FIG. 4 is a side view of an example of the bit of FIG. 2 in a sealing configuration in accordance with the present invention.

Referring now to FIG. 4, illustrated is an example of the drilling system 20 initiating a sequence for fracturing the formation 24. In the example of FIG. 4, the bit 40 is shown at a depth in the wellbore 22 adjacent a designated zone Z where fracturing is to be attempted. In this example of fracturing, the nozzles 46 are closed thereby restricting fluid from exiting the bit 40 through the nozzles 46. In contrast and as discussed above, the fracturing nozzles 52 are shown set into an open position so that fluid may be discharged from the bit 40 through the fracturing nozzles 52. In the example of FIG. 4, the collar 60 is optionally illustrated on the drill string 26 and proximate an upper end of the bit 40. On an outer circumference of the collar 60 is a packer 82 that is shown being inflated and expanding radially outward from the collar 60 and into sealing engagement within inner surface of the wellbore 22. The packer 82 when inflated and sealing against the wellbore 22 defines an upper terminal end of an annular space 84. The inner and outer radii of the space 84 terminate respectively at the bit 40 and wellbore 22, and the lower end of the space 84 terminates at a bottom of the wellbore 22. The space 84 is thus sealed from portions of the wellbore 22 that are above the collar 60. In an example, after forming the sealed space 84, fluid is discharged from the fracturing nozzles 52 into the space 84 that pressurizes the space 84 and exerts a stress on the formation 24 that exceeds a tensile stress in the rock formation 24.

Figure 5:
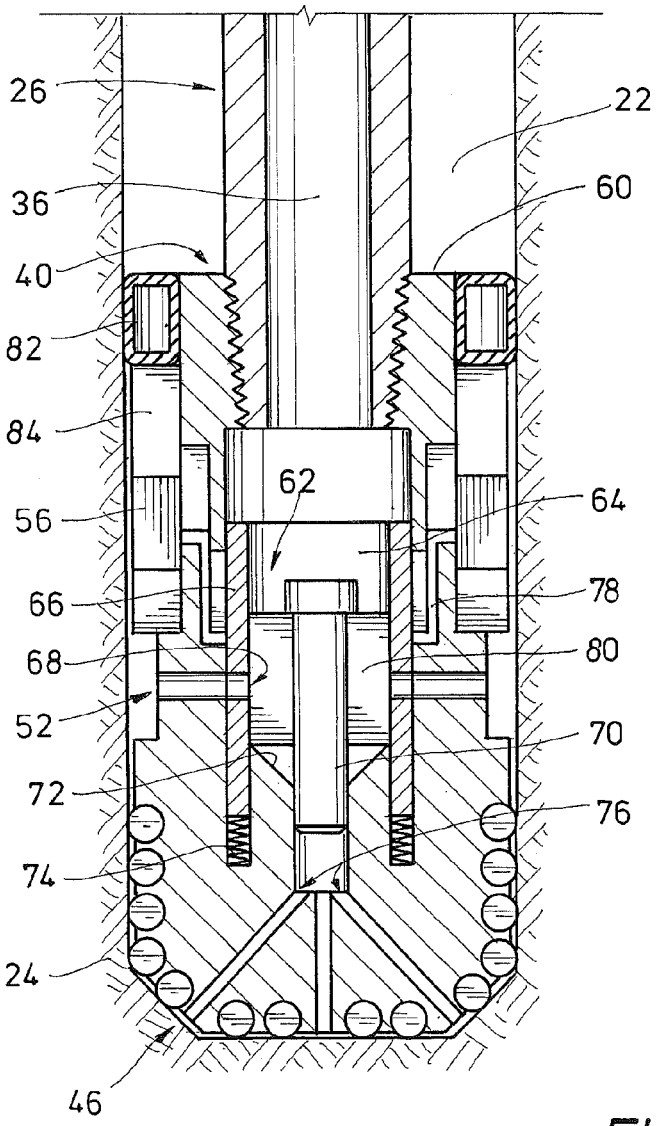
FIG. 5 is a side partial sectional view of an example of the bit of FIG. 2 during a fracturing sequence in accordance with the present invention.

The bit 40 is selectively transformable from the drilling configuration of FIG. 2 into a fracturing configuration; which is shown in more detail in a side sectional view in FIG. 5. In the fracturing configuration, the valve assembly 62 has been moved axially downward so that a lower end of the plunger 70 inserts inside of the inner surface of the walls 72. As such, flow into the passages 76 is blocked by the plunger 70, thereby terminating flow from the exit nozzles 46. The springs 74 are in a compressed configuration and axially deformed by the downward movement of the sleeve 66. Further illustrated in the example of FIG. 5 is that the ports 68 have moved axially downward with movement of the sleeve 66 and into registration with the fracturing nozzles 52. Thus, fluid entering the chamber 64 from the drilling string 26 can then exit outward from the fracturing ports 52 and into the space defined between the bit 40 and side walls of the wellbore 22.

Figure 6:
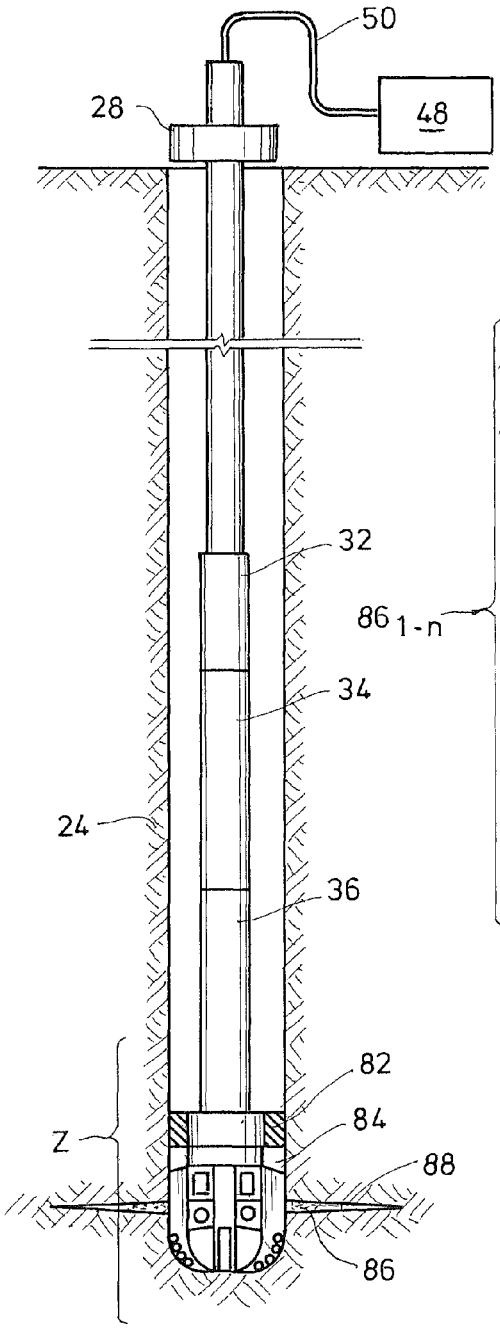
FIG. 6 is a side partial sectional view of an example of the drilling system and drill bit of FIG. 1 during a fracturing sequence in accordance with the present invention.

By forcing fluid from the bit 40 into the sealed space 84, a step of fracturing may be commenced within the formation 24. Optionally, the intensifier 36 may be activated for increasing pressure of the fluid flowing within the drill string 26 to ensure pressure in the space 84 overcomes tensile strength of the formation 24. Referring to the example of FIG. 6, a fracture 86 is shown extending into the formation 24 after having been initiated at the wellbore wall in response to the pressurization of the sealed space 84. In the example of FIG. 6, fluid 88 is illustrated in the space 84 and making its way into the fracture 86. In one example operation, the fluid 88 can be drilling fluid but can also be a dedicated fracturing fluid. In one example the fluid 88 is solid-free acidic brine or other non-damaging type of fluid. In one example, from about 100 barrels to about 150 barrels of fluid are discharged from the fracturing nozzle 40 during the step of fracturing the formation 24. Yet further optionally, a proppant may be included within the fracturing fluid for maintaining the fractures 86 in an open position for enhancing permeability, as well as trapping sand that may otherwise flow into the wellbore 22 from the formation 24. While the fracture 86 is shown to be in a generally horizontal position, other embodiments exist wherein the fractures are oriented to extend along a plane of minimum horizontal principal stress so that multiple transverse fractures can be created that extend further into the rock formation away from the wellbore wall. Further, the swivel master 32 may be initiated during fracturing so that the portion of the drill string 26 above the swivel master 32 may continue to rotate without rotating the portion below the swivel master 32. Rotating the drill string 26 above the swivel master 32 can avoid it sticking to the wall of the wellbore 22.

Figure 7:
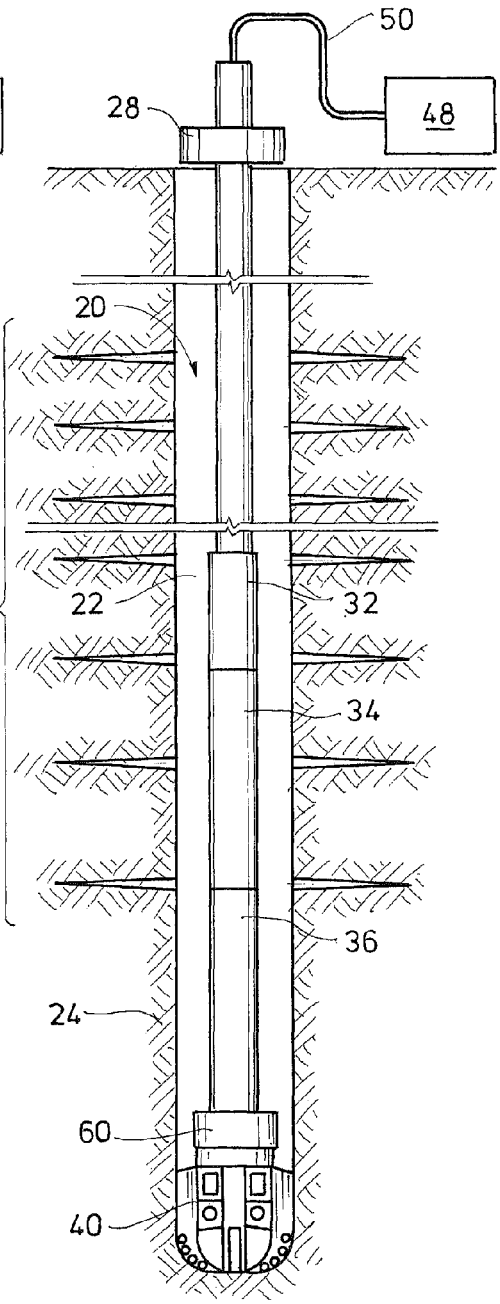
FIG. 7 is a side partial sectional view of an example of the drilling system and drill bit of FIG. 6 in a wellbore having fractures in multiple zones in accordance with the present invention.

Optionally, as illustrated in FIG. 7, the drilling system 20, which may also be referred to as a drilling and fracturing system, may continue drilling after forming a first fracture 86 and wherein the process of creating a fracture is repeated. As such, in the example of FIG. 7 a series of fractures $\mathbf{86}_{1-n}$ are shown formed at axially spaced apart locations within the wellbore 22. Further illustrated in the example of FIG. 7 is that the packer 82 (FIG. 6) has been retracted and stowed adjacent the collar 60 thereby allowing the bit 40 to freely rotate and further deepen the wellbore 22.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, a locking mechanism can be included to lock the isolation device in place. Also, shear pins may optionally be included to allow unsetting of the isolation device when being pulled. These and other similar modifications will readily suggest themselves to those skilled in the art, and are intended to be encompassed within the spirit of the present invention disclosed herein and the scope of the appended claims.

What is claimed is:

1. An earth boring bit comprising:

a body;

a connection selectively attachable to a drill string;

a chamber in the body in selective fluid communication with an inside of the drill string;

an exit nozzle having a discharge on an outer surface of the body and in selective communication with the chamber;

a fracturing port having a discharge on an outer surface of the body and in selective communication with the chamber; and a valve assembly in the chamber selectively moveable from a drilling position that blocks fluid communication between the fracturing port and chamber to a fracturing position that blocks fluid communication between the exit nozzle and chamber;

wherein the valve assembly comprises a sleeve, an elongated plunger mounted to the sleeve, and apertures in the sleeve.

2. The bit of claim 1, wherein when the valve assembly is in the drilling position, a solid portion of the sleeve is disposed adjacent an interface between the chamber and the fracturing port so that fluid communication between the chamber and the fracturing port is blocked.

3. The bit of claim 1, wherein when the valve assembly is in the fracturing position, the apertures register with the fracturing port and an end of the plunger seals an interface between the exit nozzle and the chamber.

4. The bit of claim 1, wherein the valve assembly is moveable from the drilling position to the fracturing position by flowing a designated amount of fluid through the drill string and into the drill bit.

5. The bit of claim 1, further comprising a spring in the chamber on an end of the sleeve for moving the valve assembly from the fracturing position to the drilling position.

6. The bit of claim 1, wherein the plunger is substantially cylindrical and coaxially connected to the sleeve by web members that extend radially between the plunger and the sleeve.

7. The bit of claim 1, further comprising a selectively expandable packer disposed on the body, so that when the packer is in communication with pressurized fluid in the drill string, the packer expands radially outward into sealing contact with an inner surface of a wellbore.

8. The bit of claim 1, further comprising blades fixed on an outer surface of the body that have an elongate side disposed substantially parallel with an axis of the body to define channels between adjacent blades, sliding blades on the outer surface of the body, that are selectively slideable along an axial path on the outer surface of the body and into and out of the channels.

9. The bit of claim 8, wherein the sliding blades are connected to the sleeve by a linkage that extends through slots in the body.

10. The bit of claim 1, further comprising cutter blades on the body that are equipped with cutters.

11. An earth boring bit comprising:

a body having a connection for selective attachment to a drill string;

a chamber in the body in communication with an annulus in the drill string;

a discharge nozzle on the body in selective communication with the chamber;

a sealing element on the body that selectively expands radially outward into sealing engagement with an inner surface of a wellbore wall when the bit is disposed in the wellbore; and further comprising a valve assembly disposed in the chamber for providing communication between the chamber and the discharge nozzle.

12. The bit of claim 11, wherein the sealing element comprises a packer that is filled with fluid from the annulus of the drill string to expand radially outward.

13. The bit of claim 11, wherein the discharge nozzle comprises a fracturing port and the valve assembly comprises a sleeve having a radially formed aperture and that is moveable from a blocking position with a solid portion of the sleeve adjacent an interface between the fracturing port and chamber to block communication between the chamber and fracturing port, to a communication position with the aperture registered with the interface so that the fracturing port is in communication with the chamber through the aperture.

14. The bit of claim 11, wherein the discharge nozzle comprises a drilling fluid nozzle and the valve assembly comprises a substantially cylindrical plunger that is moveable to adjacent an interface between the drilling fluid nozzle and chamber to block communication between the chamber and drilling fluid nozzle.

15. The bit of claim 11, wherein the discharge nozzle comprises a drilling fluid nozzle, the bit further comprising a fracturing port, and wherein when the bit is operated to drill the wellbore, the valve assembly blocks communication between the fracturing port and the chamber and opens communication between the drilling fluid nozzle and the chamber, and wherein when the bit is operated to fracture the wellbore, the valve assembly opens communication between the fracturing port and the chamber and blocks communication between the drilling fluid nozzle and the chamber.

16. The bit of claim 11, wherein the discharge nozzle comprises a drilling fluid nozzle, the bit further comprising a fracturing port that is disposed between the drilling fluid nozzle and the connection on the body.

* * * * *